United States Patent [19]

Hamlin

[11] 4,121,757

[45] Oct. 24, 1978

[54] FLAP ARRANGEMENT FOR A CARRIER CARTON

[75] Inventor: John R. Hamlin, Orange, Calif.

[73] Assignee: Container Corporation of America, Chicago, Ill.

[21] Appl. No.: 871,922

[22] Filed: Jan. 24, 1978

[51] Int. Cl.[2] ..... B65D 5/46; B65D 25/22

[52] U.S. Cl. ..... 229/52 B; 229/DIG. 9

[58] Field of Search ..... 229/52 B, DIG. 9

[56] References Cited

U.S. PATENT DOCUMENTS

| | | | |
|---|---|---|---|
| 1,894,873 | 1/1933 | Johnson | 229/DIG. 9 |
| 3,378,187 | 4/1968 | Sherrill et al. | 229/DIG. 9 |
| 4,030,661 | 6/1977 | Farquhar | 229/52 B |

FOREIGN PATENT DOCUMENTS

| | | | |
|---|---|---|---|
| 937,385 | 9/1963 | United Kingdom | 229/DIG. 9 |

*Primary Examiner*—Davis T. Moorhead

*Attorney, Agent, or Firm*—Carpenter & Ostis

[57] ABSTRACT

A partial interior end wall of a carton is formed from a pair of flaps, one of which has a projection which is sealed to the other flap providing improved wall structure in a carton formed from a nestable blank.

3 Claims, 6 Drawing Figures

FLAP ARRANGEMENT FOR A CARRIER CARTON

BACKGROUND OF THE INVENTION

1. Field of the Invention

This invention relates to cartons formed from paperboard and, more particularly, to cartons having improved sealing characteristics.

2. The Prior Art

The arrangement of flaps for forming and sealing carton walls illustrated in FIGS. 5 and 6 of the drawing represents the arrangement used heretofore in the packaging industry. The two figures are included to emphasize the advancement made by the present invention. The configurations and arrangement of flaps used heretofore provides uneven sealing compression when the carton is sealed. Two rectangular flaps attached to each other in an overlapping relationship leave a substantial gap (136), shown in FIG. 6, and thus create a poor adhesion of the components forming a wall of a carton. Consequently, the carton does not possess sufficient sealing qualities.

The present invention overcomes the disadvantages encountered in the prior art and provides a carton having good sealing qualities. The extended tab 28 on flap 26 is employed to get greater contact between the dust flaps and the outer closure panels to improve the end closure seals. For the type of package shown in the application (a carrier for 12/12 oz. cans) poor adhesion between the dust flaps and outer panels creates a potential hazard. The weight of the cans will pop any marginal bond and spill cans.

This greater contact between the panels is particularly important if the adhesive used to close the end flaps so a preapplied adhesive. The preapplied pattern does not have a great deal of thickness, so in the conventional split panel arrangement as shown in FIGS. 5 and 6 the preapplied pattern on flap 130 is virtually useless because it does not really contact the inner surface of panel 124.

SUMMARY OF THE INVENTION

A partial interior wall of a carton is formed from a pair of flaps. One of these flaps has a projection while the other one has a portion thereof, corresponding in configuration and size to the projection, removed therefrom. The projection is sealed to an area of the other flap in an overlapping manner. This arrangement substantially reduces the sealing compression problem which exists in the prior art.

DRAWING

Figure 1:
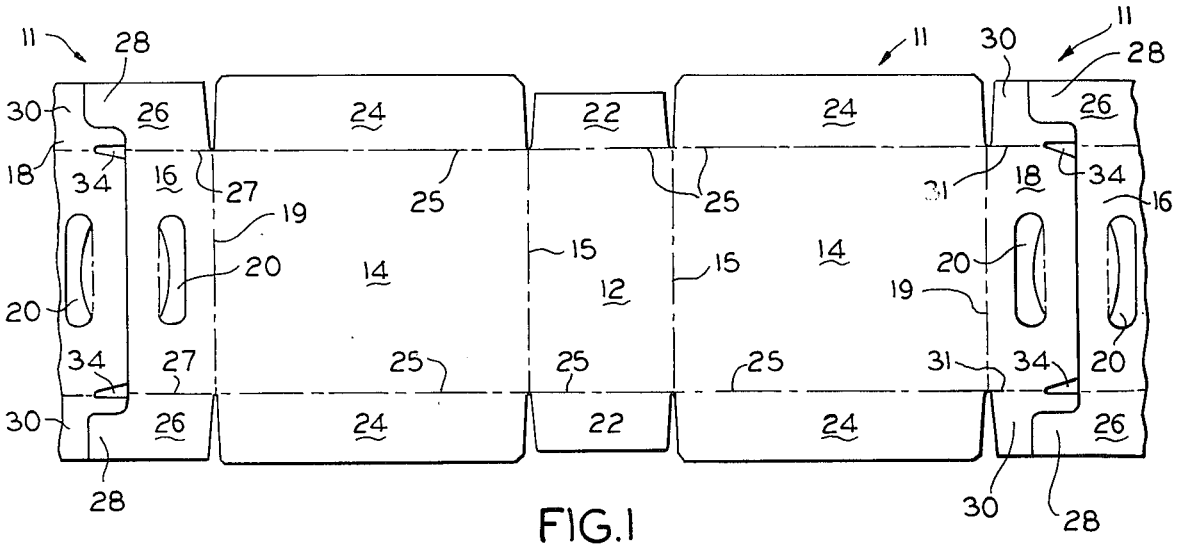
FIG. 1 is a plan view of a nesting blank from which the carton of the present invention is formed.
Figure 2:
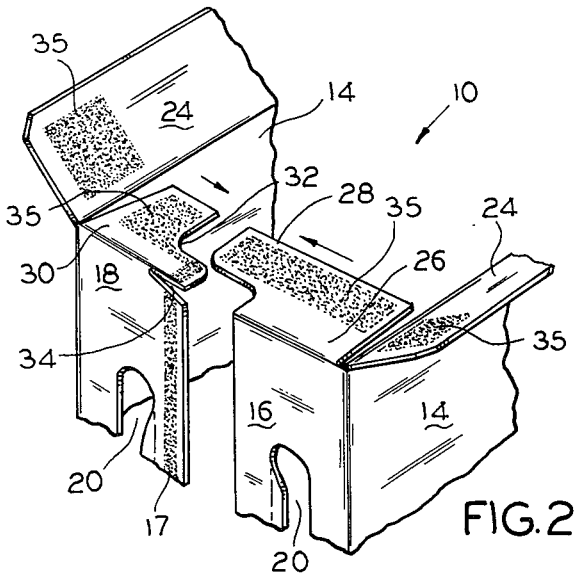
FIG. 2 is a perspective view of a portion of a carton in a partially erected condition.
Figure 3:
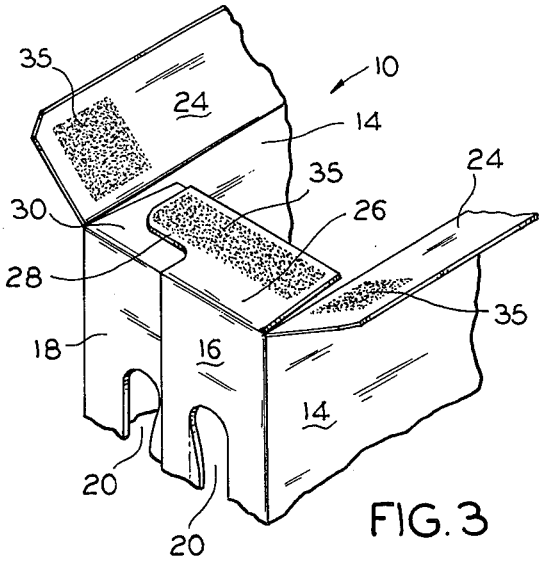
FIG. 3 is a perspective view of a portion of a carton showing further erection.
Figure 4:
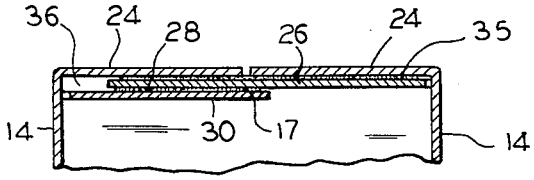
FIG. 4 is a sectional view of a carton similar to that shown in FIG. 3 after it has been sealed.

Referring now to the drawing, more specifically to FIGS. 1 through 4, there is shown a carton 10 formed from a nesting blank 11.

The carton has a bottom wall 12 and a pair of side walls 14 hingedly attached to the side edges of said bottom wall along fold lines 15.

A top wall of the carton is formed from two top wall forming sections. First of such sections, designated 16, is foldably hinged to an edge of one of said side walls 14 along a fold line 19 while the second of said sections, identified with reference numeral 18, is similarly attached to an edge of the other of said side walls 14 along a fold line 19. Both top wall forming sections 16 and 18 have hand holes 20 formed therein for providing carrying means for the carton.

End wall forming panels 22 are hinged to the end edges of the bottom wall 12 along fold lines 25. Likewise, end wall forming panels 24 are hingedly attached to the edges of the respective side walls 14 along fold lines 25.

The top wall forming section 16 has a flap 26 foldably attached to each of the two end edges of the section along hinge lines 27. Each of the flaps 26 has a projection 28 extending outwardly therefrom.

The top wall forming section 18 has a flap 30 hinged to each of the two end edges of the section along hinge lines 31. Each of the flaps 30 has a portion 32 removed therefrom which corresponds in size and shape to the projection 28 and, as best seen in FIG. 1, allows nesting of the blanks 11 since the portion 32 of one blank abuttingly mates with the projection 28 of the next blank.

A pair of V-shaped cut-outs 34 are formed in the section 18. As it is well known in the art, the cut-outs are used where overlapping panels are hinged along a common score line to prevent build up.

To form the initial tubular or sleeve-like configuration, a line of adhesive 17 is applied to an outer surface of the panel 18 and another line of adhesive (not shown) is applied to the underside of the extension 28 of the flap 26.

To close the end of the carton, a pattern of preapplied adhesive 35 on the outside surface of the flap 26 is mated with the patterns of the preapplied adhesive 35 on the inside surfaces of the panels 24.

Figure 6:
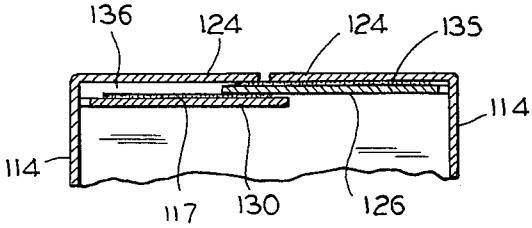
FIG. 6 is a sectional view of a carton similar to that shown in FIG. 5 after it has been sealed.
Figure 5:
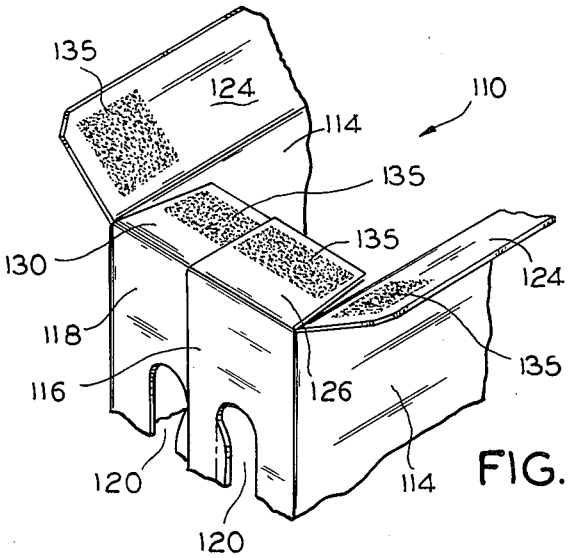
FIG. 5 is a perspective view of a portion of a carton in a partially erected condition representing the flap arrangement used heretofore.

Referring now to FIGS. 5 and 6 there is shown a carrier carton 110 having a flap arrangement heretofore used in the packaging industry. The presentation of FIGS. 5 and 6 is made for the purpose of a comparison with the arrangement illustrated in FIGS. 1 through 4.

In FIGS. 5 and 6 elements corresponding to the elements shown in FIGS. 1–4 have been identified with the same numerical identifiers except the numbers have been increased by 100.

Thus, the carton has side walls 114, top wall forming sections 116 and 118 and end wall forming panels 124.

A flap 126 is hinged to the section 116 while a flap 130 is hinged to the section 118. Both flaps, 126 and 130, are rectangular in configuration and have adhesive 135, or the like, applied to their top surfaces. In sealing the end wall of the carton, the flap 126 is placed in an overlying position with respect to the flap 130 and is joined thereto. Subsequently, panels 124 are folded toward the flaps 126 and 130. One of the panels 124 engages the adhesive 135 on the surface of the flap 126 and is adhesively secured thereto. Since the distance between the flap 130 and its adjacent panel 124 is greater than the distance between the flap 126 and its adjacent panel 124, a gap 136 is formed between the panel 124 and the flap 130 when the end wall of the carton is closed. The gap 136 materially reduces the compressive sealing and siftproof qualities of the carton.

I claim:

1. A carton formed from a cut and scored, nestable blank of paperboard, comprising:

(a) a bottom main wall and a pair of side main walls hinged to said bottom main wall along opposite side edges thereof;

(b) end walls formed from a plurality of end wall forming panels hinged to the end edges of at least certain of said main walls and forming therewith a structure open at its top;

(c) a top wall formed from first and second top wall forming sections;

(d) said top wall forming sections having carton carrying means formed therein and providing a carrying handle at said manufacturer's joint;

(e) each of said top wall forming sections having a flap foldably hinged along a hinge line to each end thereof, including:

(i) a first flap hinged to said first section and having an outwardly extending projection;

(ii) a second flap hinged to said second section and having a portion thereof corresponding in configuration to said projection removed therefrom;

(iii) said projection overlapping an area of said second flap and being secured thereto forming a continuous flap;

(f) said continuous flap being folded inwardly to form a partial interior end wall of said carton.

2. A carton as defined in claim 1, wherein said continuous flap is secured to each one of said end wall forming panels comprising one of said end walls.

3. A carton as defined in claim 1, wherein adhesive is located in a pre-selected pattern on the outside surface of said continuous flap and on the inside surfaces of said end wall forming panels to secure said flap to said panels.

* * * * *